United States Patent [19]

Barber

[11] 4,266,482

[45] May 12, 1981

[54] VEHICLE CONVEYOR SYSTEM HAVING DOUBLE CHAIN DRIVE AND SELECTABLE DOLLY

[75] Inventor: Ivan J. Barber, Toronto, Canada

[73] Assignee: The Allen Group, Inc., Melville, N.Y.

[21] Appl. No.: 883,027

[22] Filed: Mar. 3, 1978

[30] Foreign Application Priority Data

Feb. 9, 1978 [CA] Canada ..... 296552

[51] Int. Cl.[3] ..... B61B 13/12; B61B 10/04

[52] U.S. Cl. ..... 104/172 B; 198/718

[58] Field of Search ..... 104/162, 172 R, 172 B, 104/178; 198/718, 732

[56] References Cited

U.S. PATENT DOCUMENTS 3,403,635 10/1968 Smith ..... 104/172 B

*Primary Examiner*—Randolph A. Reese

*Attorney, Agent, or Firm*—Klarquist, Sparkman, Campbell, Leigh, Whinston & Dellett

[57] ABSTRACT

A selectable dolly vehicle conveyor system having spaced dollies mounted between two drive chains and normally moving on a lower track concealed beneath an upper track. A ramp for shunting the rear part of a dolly to the upper track to push a vehicle, operates only when both the front wheel of such vehicle holds depressed a threadle switch located beyond the ramp and at the same time the front roller of such dolly has passed the ramp and depresses a dolly threadle plate on the lower track. This permits the front part of the dolly to pass the ramp unobstructed and ensures that only the rear part of the dolly will be shunted to the upper track, even though the front and rear parts of the dolly are longitudinally aligned.

7 Claims, 7 Drawing Figures

FIG. 1
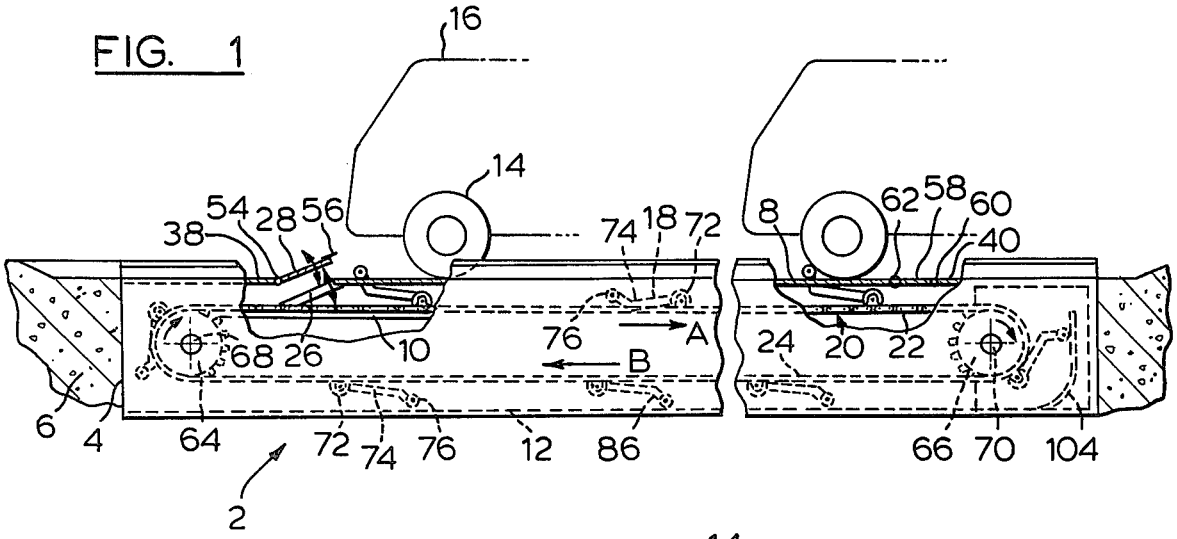
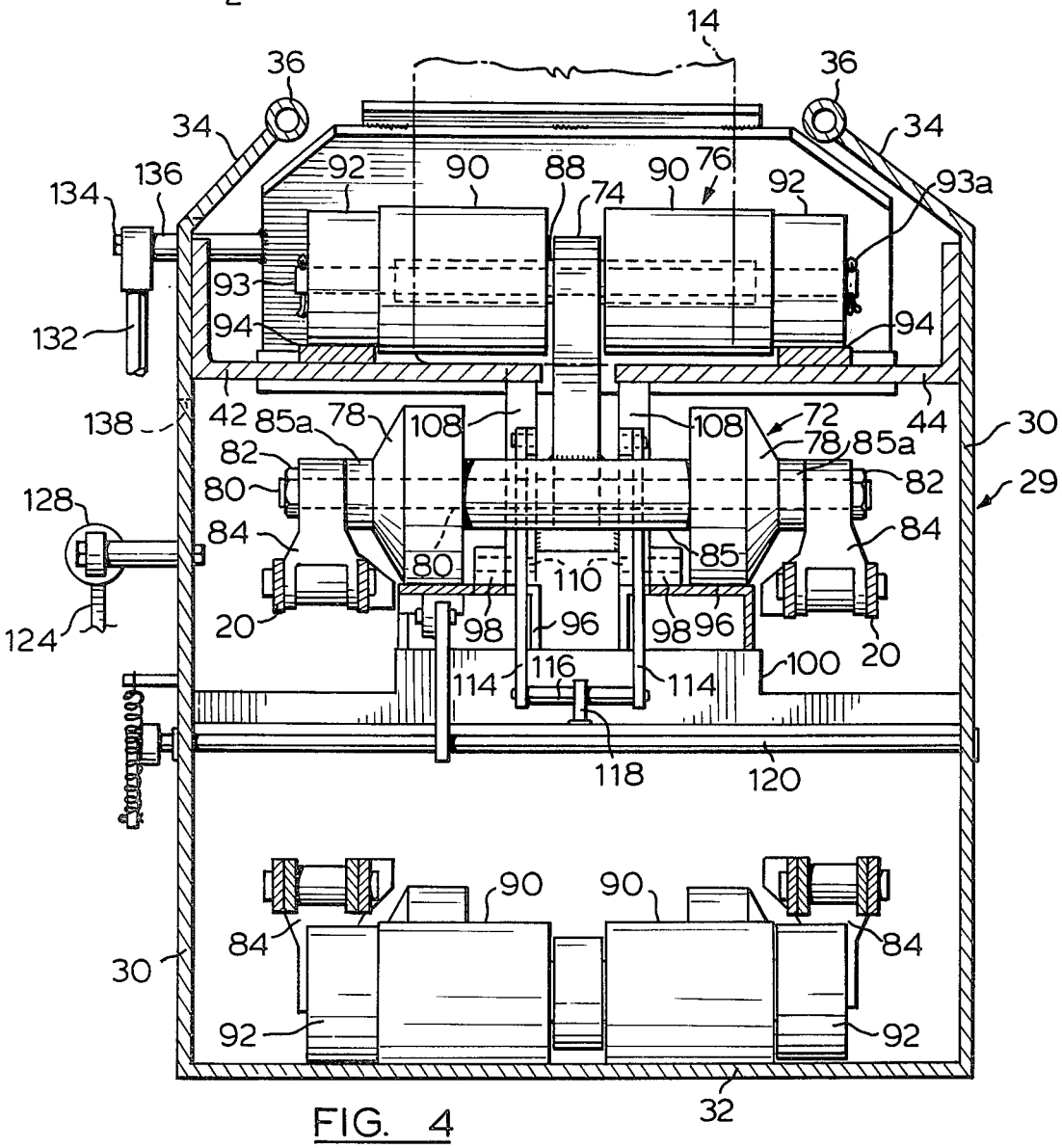
FIG. 4

VEHICLE CONVEYOR SYSTEM HAVING DOUBLE CHAIN DRIVE AND SELECTABLE DOLLY

This invention relates to a vehicle conveyor system of the kind used primarily in car washes.

Car washes commonly include conveyors which move the vehicle to be washed forwardly through the wash equipment. Such conveyors usually include chains with hooks or wheel engaging dollies attached hereto, moving in the open where they can catch the feet of unwary workers. Because of the dangers thus created, some conveyor systems have been used in which the chains, and vehicle wheel engaging dollies attached to the chains, are normally carried along a path located below the surface on which the vehicle travels. When a vehicle enters the system, a lifter cams part of the dolly to the top surface on which the vehicle travels, and the exposed part of the dolly then pushes the vehicle along the required path. Such a system is shown in U.S. Pat. No. 3,554,132 issued Jan. 12, 1971 and assigned to Daniel C. Hanna. Such conveyors are often termed "selectable dolly" systems, because a dolly is selected and moved to the upper track of the system for use only when required.

A disadvantage of existing selectable dolly conveyor systems is that they all employ a single chain to pull the dollies. Because of the loose tolerances which inevitably occur in such systems and the heavy and sudden loads which are involved in pulling vehicles which are not always centered, the chain is subjected to severe twisting wear and can wear out in a relatively short period of time. However, because of the need to be able to lift part of the dolly to an upper track to push a vehicle while leaving the remainder of the dolly attached to the drive chain, it has not been possible in the past to build a two chain selectable dolly system.

Accordingly, the present invention provides a selectable dolly vehicle conveyor system having two parallel chains moving in unison and to which the dollies are connected. Each dolly has front rollers which roll on a lower track and rear rollers which can roll either on the lower track or on an upper track to engage a vehicle wheel. Because the rear rollers are generally longitudinally aligned with the front rollers, a conventional ramp system for lifting the rear rollers to the upper track while permitting the front rollers to pass unimpeded cannot be used. Instead, a special control system is employed which detects when a vehicle has passed the ramp and also when the front rollers of a dolly have passed the ramp, and then when both such events have occurred, raises the ramp to shunt the rear rollers of the dolly to the upper track.

Further objects and advantages of the invention will appear from the following description, taken together with accompanying drawings, in which:

FIG. 1 is a simplified side view, partly in section, showing a conveyor system of the invention;

FIG. 4 is a sectional view taken along lines 4—4 of FIG. 3;

Figure 2:
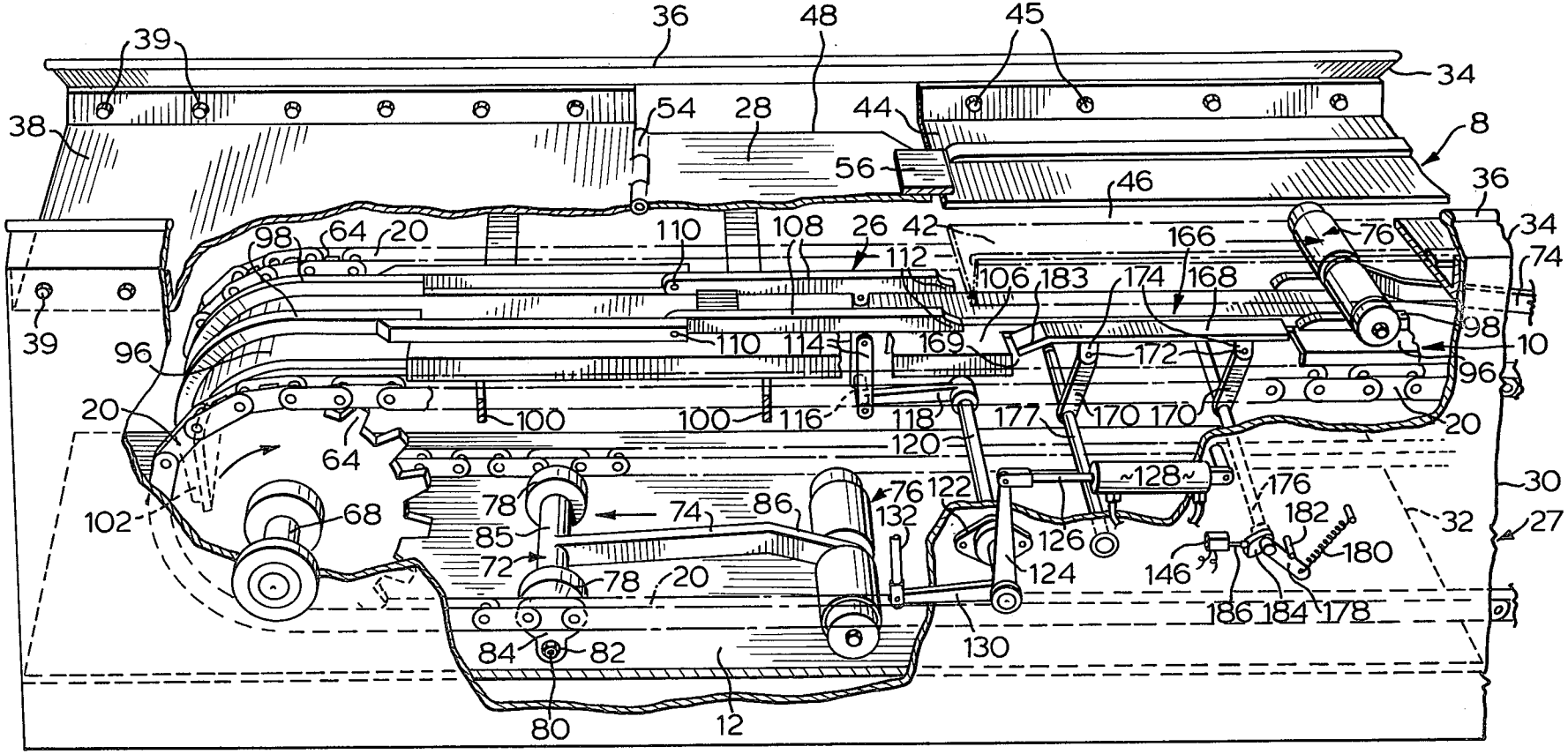
FIG. 2 is a perspective view, partly broken away, showing the front portion of the conveyor system of FIG. 1 with the ramp in its down position.

Reference is first made to FIG. 1, which shows a conveyor system 2 according to the invention mounted in a pit 4 formed in concrete 6. The conveyor system 2 has three tiers, constituted by an upper track 8, a lower track 10, and a return portion 12. The upper track 8 carries the wheels 14 on one side of a vehicle 16 to be washed. The lower track 10 carries dollies 18 which are mounted on and propelled by a pair of parallel chains 20, as will be described (only one chain 20 is shown in FIG. 1). The chains 20 have upper flights 22 which move in the direction of arrow A, and lower flights 24 which move in the direction of arrow B. The dollies 18 roll on the return portion 12 as they are carried by lower flights 24 of the chains in the direction of arrow B.

For convenience of terminology, movement in the direction of arrow A (which is the direction of movement of the vehicle being washed) will hereafter be referred to as "downstream", and movement in the direction of arrow B will be referred to as "upstream".

As shown in FIG. 1, the dollies 18 normally ride on the lower track 10 and return portion 12, beneath the upper track 8, so they cannot pose a danger to workers in the car wash. However, when a vehicle 16 is to be pushed, a ramp 26 is raised to shunt the upstream or rear portion of a dolly 18 to the upper track 8, and a lid 28 is also raised at this time to provide space for this movement. The rear portion of the dolly 18 then pushes the vehicle 16 through the car wash and then is returned to the lower track 10, by means to be described.

Figure 3:
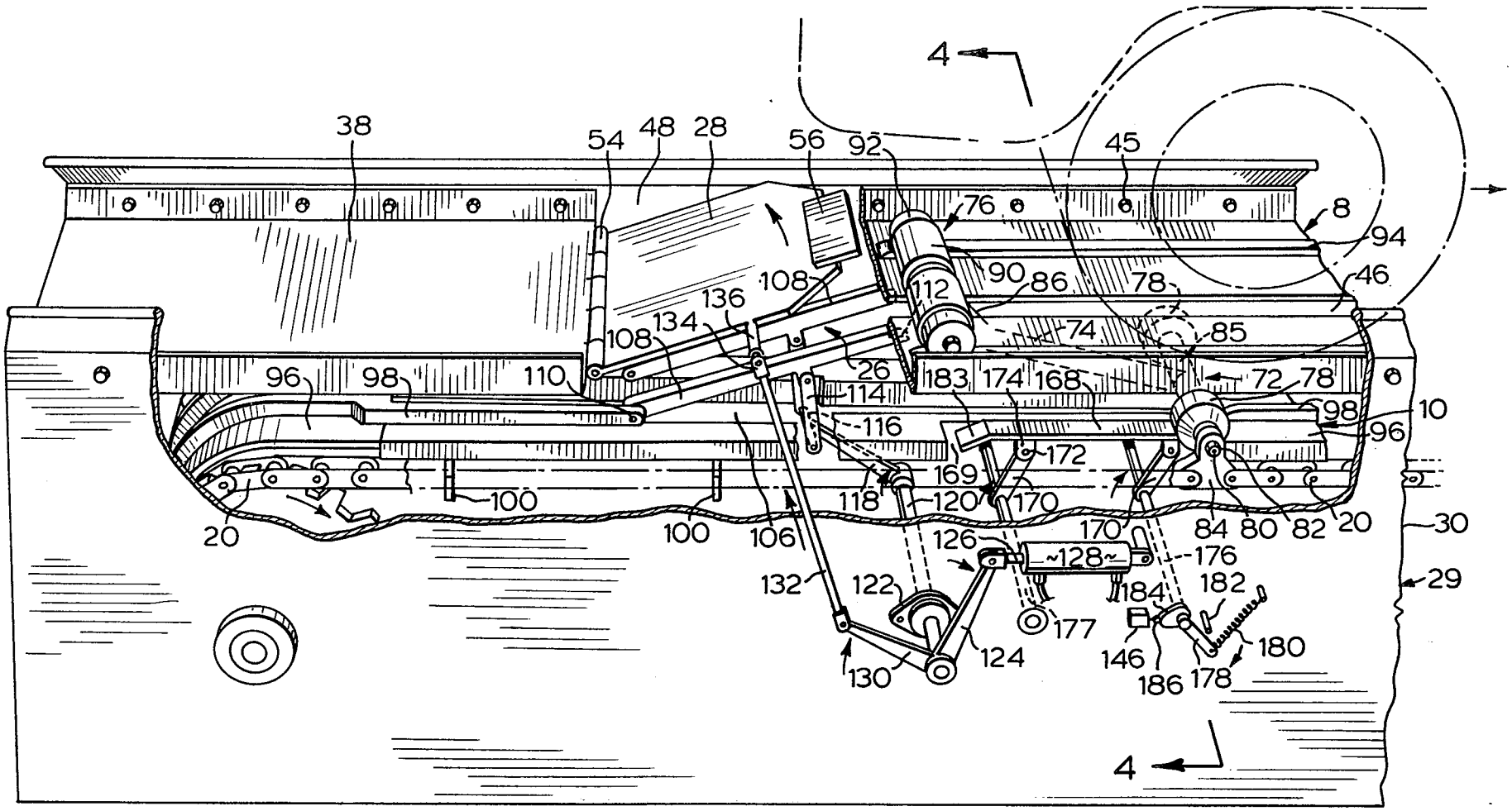
FIG. 3 is a perspective view similar to that of FIG. 2 but showing the ramp in its up position.

Reference is next made to FIGS. 2 to 4, which show the conveyor system 2 in more detail.

As shown in FIGS. 2 and 4, the conveyor system 2 includes a box-frame 29 having elongated steel sides 30 and a steel bottom 32. At their tops the sides 30 converge inwardly as shown as 34 and terminate in elongated rolled flanges 36 which serve to guide a vehicle wheel 14 between them.

The upper track 8 is constituted, at the entrance or upstream end of the conveyor system, by a U-shaped entrance plate 38, the sides of which are bolted by bolts 39 to the upper portions of the frame sides 30. A similar exit plate 40 (FIG. 5) is located at the exit or downstream end of the conveyor system. Between the entrance and exit plates 38, 40, the upper track 8 is constituted by a pair of opposed L-shaped flanges 42, 44, the edges of which are bolted to the upper inner surfaces of sides 30 of the box frame 29 by bolts 45. The L-shaped flanges 42, 44 define an elongated longitudinally extending slot 46 between them, to accommodate an arm (to be described) of the dollies 18.

Figure 5:
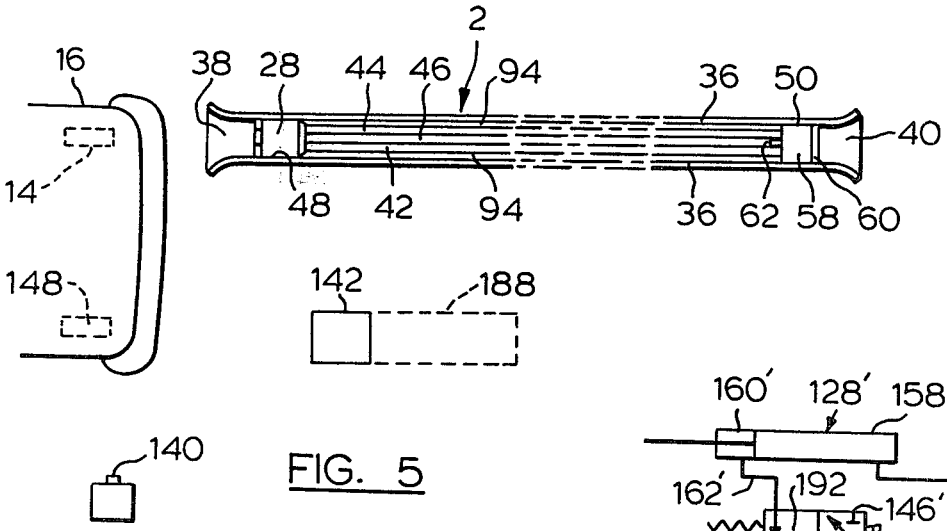
FIG. 5 is a plan view showing the conveyor system of FIGS. 1 to 4 from above.

The L-shaped flanges 42, 44 are spaced longitudinally from the entrance and exit upper track plates 38, 40 by gaps or slots 48, 50 (FIGS. 2, 5). Slot 48 is normally covered by the lid 28. The lid 28 is hinged at 54 to the entrance plate 38 and has at its free end a stop 56 which normally rests on the flanges 42, 44. The slot 50 is normally covered by a second lid 58, which is hinged at 60 at its downstream end to the exit plate 50 and which also has a stop (not shown) which normally rests on the flanges 42, 44. A roller 62 is rotatably mounted at the free end of lid 58 and is located in the slot 46, for a purpose to be described.

Located within the box frame 29 are two front sprockets 64 and two rear sprockets 66, which carry the chains 20. The sprockets 64 are fixed to a common axle 68 which is driven by a motor, not shown. The rear sprockets 66 are fixed to a common axle 70 which is journalled in bearings, not shown.

Each dolly 18 includes (see particularly FIGS. 3, 4) a front or downstream roller assembly 72, a longitudinally extending central arm 74, and a rear or upstream roller assembly 76. The front roller assembly 72 includes a pair of laterally spaced first or front rollers 78 rotatably mounted on an axle 80. Each end of the axle 80 is threaded and is secured by nuts 82 to generally triangular shaped links 84 which form a part of the chains 20. The rollers 78 are spaced apart by a tubular axle housing 85 within which the axle 80 rotates, and are spaced from the links 84 of the chains by tubular shims 85*a*. Since the two chains 20 are evenly aligned, the front roller assembly 72 is pulled squarely in a downstream direction by the chains 20.

The arm 74 is welded to the axle housing 85 centrally between the ends of the axle. With reference to a dolly 18 on the top flights 22 of the chains 20, the arm 74 extends upstream and slightly upwardly adjacent its end 86, where it is connected to an outer axle 88 of the rear roller assembly 76. Each rear roller assembly 76 includes (FIG. 4) a pair of inner rollers 80 which are rotatably mounted on the axle 88, one on each side of arm 74, and a pair of outer slightly smaller diameter rollers 92 which are also rotatably mounted on an inner axle 93, outboard of the rollers 90.

The axle 93 is rotatably journalled within axle 88. The rollers 90, 92 of the rear roller assembly 76 are separated from each ohter and from the arm 74 by washers, not shown, and the outer rollers 92 are held on inner axle 93 by cotter pins 93*a*. As shown, the outer rollers 92 roll on slightly raised portions 94 of the upper track 8, to raise the inner rollers 90 clear of the flanges 42, 44. This allows the inner rollers 90 to rotate freely in the air. The inner rollers 90 serve to engage the vehicle wheel 14 and push the vehicle wheel along the conveyor system.

The lower track 10, on which the front rollers 78 of each dolly 18 normally roll when the dolly is travelling in a downstream direction, includes a pair of laterally spaced U-shaped members 96. The U-shaped members 96 have opposed inner guide flanges 98 projecting above their upper surfaces. The U-shaped members 96 extend longitudinally beside the upper flights of the chains and are supported by cross members 100 welded to the frame sides 30. At both ends of the conveyor, the U-shaped members 96 curve downwardly as indicated at 102 in FIG. 2, to guide the dollies as they enter and leave the lower track 10. The U-shaped members 96, by supporting the front rollers 78 of the dollies, act to support the long run of the upper flights 22 of the chains 20 between the sprockets 64, 66. The inner guide flanges 98 of members 96 also serve to support the rear roller assembly 76 of each dolly by acting as rails on which the inner rollers 90 roll.

As the dollies 18 pass around the downstream sprockets 66, they are held against rapid pivoting movement by a deflection plate 104 diagrammatically indicated in FIG. 1. At the return portion 12 of the conveyor, the rollers 90 ride on the flat bottom plate 32 of the box frame 10.

The ramp 26, which when raised shunts the rear roller assembly 76 of a dolly from the lower track 10 to the upper track 8, is constructed as follows. As shown in FIGS. 2 and 3, the guide flanges 98 are interrupted beneath the lid 28 by a gap 106 (which also extends downstream from beneath the lid 28). Two bridge members 108 are located in the gap 106 and constitute the ramp 26. The bridge members 108 are hinged at 110 at their upstream ends to the flanges 98. At their downstream ends the bridge members 108 are shaped to form stops 112 which rest against the under surfaces of the L-shaped flanges 42, 44 (FIG. 3) when the ramp 26 is raised. Two first lever arms 114 are pivotally connected one to the bottom of each bridge members 108 and are pivotally connected to an axle 116 which extends between the bottoms of lever arms 114. A second lever arm 118 is fixed at one end to the axle 116 and is fixed at its other end to an axle 120 which is journalled at 122 in the frame side plate 30. The axle 120 is fixed to a third lever arm 124 which is pivotally connected to the piston rod 126 of a cylinder 128, and is fixed to a fourth lever arm 130 which is pivotally connected to a rod 132. The rod 132 is pivotally connected at 134 to a rod 136 which is fixed to lid 28 and extends laterally through a slot 138 (FIG. 4) in the side of the frame.

As shown in FIG. 3, when the piston rod 126 is retracted, this turns the axle 120 clockwise as drawn, raising both the ramp 26 and the lid 28. As will be explained this can only occur after the front roller assembly 72 has passed the ramp 26. The rear roller assembly 76 is then guided up the ramp 26 and onto the upper track 8, where it serves to push the wheel 14 of a vehicle 16 located on the upper track.

When the rear roller assembly 76 reaches the exit plate 40 (FIGS. 1, 5), the arm 74 engages the roller 62 mounted on the exit plate 58, camming the exit plate 58 upwardly so that the rear roller assembly 76 can drop back down to the lower track 10. The increased slope at the downstream end 86 of the arm 74 ensures that the arm 74 will cam the exit lid 58 high enough so that the rear roller assembly 76 can pass beneath such lid.

The control system for the conveyor system will next be described, with reference to FIGS. 2, 3, 5 and 6. The control system includes three switches, namely an on-off switch, namely a solenoid two way valve 140, a vehicle operated floor treadle switch 142 (FIG. 5), the switch portion of which is typically a spring biased two way valve 144, and a cam operated spring biased three way valve 146. All three switches are connected in series and all three must operate before the ramp 26 will be raised.

The on-off switch 140 is simply a switch controlled by the operator of the system, to ensure that no dollies will be selected for movement to the upper track 8 unless the system has been turned on. The on-off switch is of course optional but will be included in most systems. The floor treadle switch 142 (FIG. 5) is located for operation by a wheel 148 of the vehicle on the opposite from the wheels 14 which enter the upper track 8. The treadle switch 142 is located just ahead of the ramp 26 and lid 28, so that the ramp 26 and lid 28 will not be raised beneath the wheel 14 of the vehicle. When the on-off switch 140 is operated and when a vehicle has a front wheel 148 located on the floor treadle switch 142, then air is allowed to pass from an air supply 150 through a regulator 152, through switches 140, 144, and through conduit 154 to the three way valve 146.

Figure 6:
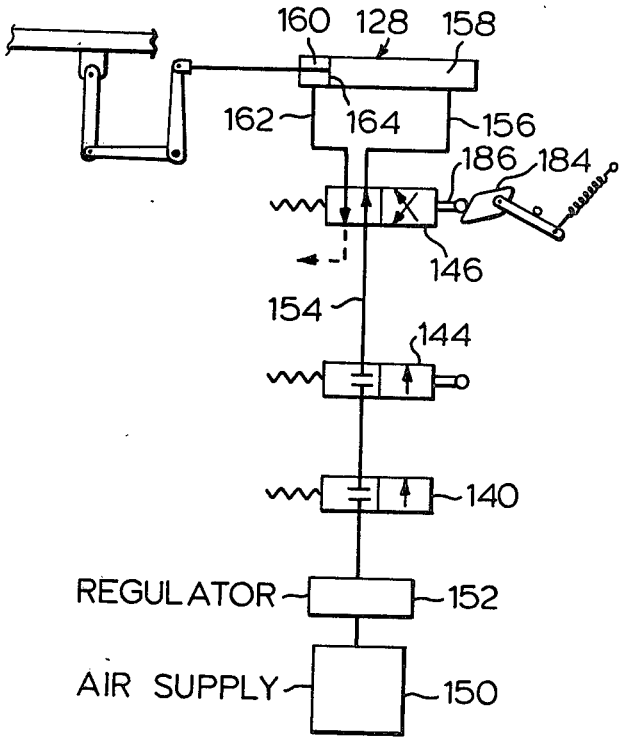
FIG. 6 is a schematic showing a preferred control circuit for the conveyor system of FIGS. 1 to 5.

The three way valve 146 is normally in the condition shown in FIG. 6, in which pressurized air passes from conduit 154 through the spool of the three way valve 146 and through conduit 156 to the butt end 158 of the cylinder 128. The rod end 160 of the cylinder 128 exhausts to atmosphere through conduit 162 and the spool of valve 146. The piston 164 is thus held extended at this time, holding the lever arms 114, 118, 125 and 130 in the positions shown in FIG. 2 and holding the ramp 26 and lid 28 in their down condition.

The three way valve 146 is actuated by a dolly treadle switch 166 located in one of the U-shaped members 96. The dolly treadle switch 166 includes a treadle plate 168 located in a gap 169 in one of the U-shaped members 96. The treadle plate 168 is supported by a pair of parallel arms 170 pivotally connected at 172 to a pair of tabs 174 projecting beneath the plate 168. The parallel arms 170 are of equal length and are fixed to parallel axles 176, 177 which are journalled in the side plates 30 of the frame. A lever arm 178 fixed to the axle 176 is biased by spring 180 in a counter clockwise direction against a stop 182, to hold the dolly treadle plate 168 in a position normally slightly raised above the upper surface of the remainder of the U-shaped member 96 which the plate 168 interrupts. The dolly treadle plate 168 has a sloping ramp-like surface 183 at its upstream end to guide a front roller 78 of the front roller assembly 72 thereon. Mounted on the axle 176 of the dolly treadle plate is a cam 184.

When a dolly 18 approaches the dolly treadle plate 168, a front roller 78 of the dolly moves onto the plate 168. This depresses the plate 168, pivotting the lever arm 178 clockwise as shown in FIGS. 2 and 3, thus turning the cam 184. The cam 184 depresses the actuator 186 of three way valve 146, shifting the spool of the three way valve so that conduit 154 is now connected through conduit 162 to the rod end 160 of the cylinder. The pressurized air from supply 150 then retracts the piston 164, moving lever arms 118, 124, 130 clockwise and raising the ramp 26 and lid 28. Upward movement of these members is limited by the stops 112 at the end of the ramp, which stops engage the under surfaces of the L-shaped flanges 42, 44. It will be noted that ramp and lid can be raised only if three conditions are satisfied at the same time, namely (1) the system has been turned on, (2) a vehicle have moved onto the floor treadle switch 142 (so that its wheels have passed beyond the ramp 26 and lid 28), and (3) the front roller assembly of the dolly to be selected has passed beyond the ramp 26.

Once the ramp 26 has been raised, then as the selected dolly 18 continues to move downstream, its rear roller assembly 76 is guided up to the ramp 26 and onto the upper track 8. The dolly treadle plate 168 is made longer than the ramp bridge members 108, to ensure that the front roller 78 will not move off the dolly treadle plate 168 (thereby causing the ramp to be lowered) until the rear roller assembly 76 has moved fully up the ramp and onto the upper track 8.

When the front roller 78 moves off the dolly treadle plate 168, the spring 80 returns the plate 168 to its raised position, and the spring biased three way valve 146 returns to its original condition illustrated in FIG. 6. The butt end 158 of the cylinder is then pressurized and the piston rod 126 is extended under power, positively shutting the ramp 26 and lid 28. The positive closing eliminates dependance on gravity to close the lid and ramp and ensures that these elements will be fully closed before the next dolly reaches the ramp.

It will be seen that with the system described, provided that the dollies 18 are spaced sufficiently far apart, only one dolly will be selected for each car. A typical dolly spacing is thirteen feet, which is greater than the wheel base of any car. Therefore, after the rear roller assembly 76 of a dolly has moved behind the front wheel of a car and has begun moving the car, the rear wheel of the car will move over the treadle switch 142 before the next dolly moves over the dolly treadle plate 168. Since the floor and dolly treadle switches 144, 146 will not be operated together, no dolly will be selected.

In some cases, however, it may be desired to select two dollies for each car. Some operators require this, despite the reduced safety of such an arrangement, because of the possibility that a first dolly selected may begin moving a car and then, if the front tire is soft, may pass under the front tire and leave the car stranded. If two dollies are to be selected for each car, then the treadle 142 will be lengthened in a downstream direction, for example to about nine feet in length, as indicated in dotted lines at 188 in FIG. 5. Then, after (or before) the front wheel of the car has moved off the treadle 142, the rear wheel of the car moves on to the treadle 142 and will remain thereon for the time required for the rear wheel to move the length of extended treadle 142. This ensures that the treadle 142 will be depressed at the time when a second dolly becomes available for selection (assuming a dolly separation distance of about 13 feet), and hence the rear roller assembly 76 of such second dolly will come up behind the rear wheel of the car (although normally such dolly will be spaced behind the rear wheel of the car).

It will be seen that if the apparatus of the invention is shut down (i.e. if the conveyor system is completely stopped) while the ramp is up, no jamming will occur since the apparatus will resume its functioning as soon as the system is turned back on. The system does not rely on time delays produced electronically or by clockwork mechanism which tend to time out when the system is shut off, causing the danger of jamming when the system is turned back on. It is understood that such timing devices can be used if desired in place of the mechanical timing arrangement shown, but the mechanical timing arrangement described, employing the dolly treadle plate 168, is greatly preferred.

As previously indicated, for smooth operation, the dolly treadle plate 168 is preferably slightly longer than the ramp bridge members 108. Thus, the treadle switch 166 will be operated and the ramp will be raised before the inner rollers 90 of the dolly have moved onto the ramp. However, the dolly treadle plate 168 can be shorter than the ramp, in which case the ramp will be raised when the rollers 90 are part way along the ramp bridge members 108. This throws the rollers 90 upwardly but still results in movement of the dolly rear roller assembly 76 onto the upper track 8.

When the arrangement is such that the dolly front roller 78 contacts the dolly treadle plate 168 before the rear roller assembly 76 has reached the ramp, then the arm 74 will of course be longer than the ramp bridge members 108. However, if the ramp is to be raised when the rear dolly assembly 76 is part way along it, then the length of the arm 74 may be reduced accordingly.

Figure 7:
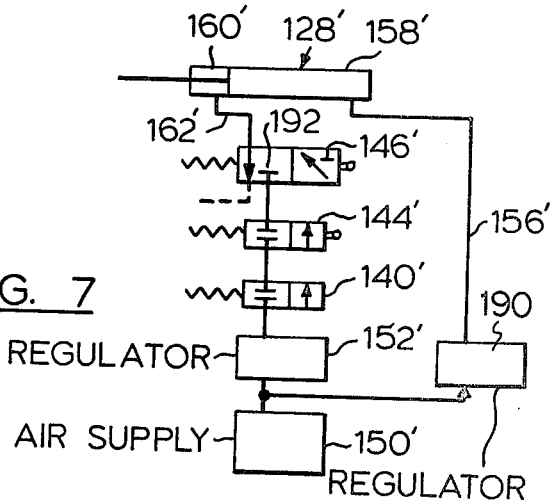
FIG. 7 shows a control circuit modified from that of FIG. 6.

A variation of the control system is shown in FIG. 7, in which primed reference numerals indicate parts corresponding to those of FIGS. 1 to 6. The only difference between the FIG. 7 system and that of FIG. 6 is that the butt end 158' of the cylinder is connected at all times via conduit 156' to a source of reduced air pressure, typically 15 or 20 psi. The low pressure air is supplied from source 150° (which typically supplies air at 80 psi) through a regulator 190 which reduces the pressure to 15 or 20 psi. Air at higher pressure from source 150' passes through valves 140', 144', 146' and conduit 162' as before but when valve 146' is not actuated, any air reaching this valve is stopped by closed port 192. When valve 146' is actuated, air at 80 psi is supplied to the rod end of the cylinder 128', where it overcomes the 20 psi air at the butt end 158' and raises the ramp and lid. The advantage of this arrangement is that less air pressure is used to lower the ramp and lid than to raise these parts, resulting in reduced clanging and vibration in the apparatus.

What I claim as my invention is:

1. A conveyor system for transporting a vehicle along a path of travel, comprising:

(a) support means having an upper track for supporting a wheel of said vehicle, a lower track beneath said upper track, and a return portion beneath said lower track;

(b) a pair of parallel laterally spaced endless chains having upper and lower flights, and means mounting said chains with said upper flights, and means mounting said chains with said upper flights adjacent said lower track and with said lower flights adjacent said return portion;

(c) drive means for driving said chains in unison with the upper flights thereof moving downstream along said direction of travel;

(d) a plurality of dollies mounted in spaced relation along said chains, each dolly comprising, with reference to a dolly positioned on said upper flight;

(i) a front roller assembly comprising a pair of laterally spaced first rollers arranged to roll on said lower track, and axle means extending laterally between said first rollers;

(ii) means mounting said front roller assembly between said chains and with said front roller assembly connected to said chains for movement therewith, with said axle means extending laterally between said chains;

(iii) an arm connected substantially at the center of said axle means and extending longitudinally upstream from said axle means;

(iv) a rear roller assembly mounted at the rear end of said arm and adapted to roll both on said upper track and said lower track, said rear roller assembly including second rollers generally longitudinally aligned with said first rollers;

(e) a ramp having upstream and downstream ends, and means mounting said ramp for movement between a first normal position in which said ramp forms a portion of said lower track and a second position in which the downstream end of said ramp is raised for said ramp to form a path from said lower track to said upper track in a downstream direction;

(f) said upper track having a slot therein above said ramp to accommodate said raised ramp and to permit said rear roller assembly to move up said ramp onto said upper track;

(g) power means for moving said ramp between said first and second positions;

(h) control means for said power means, said control means comprising:

(i) first normally off switch means mounted downstream of said ramp and responsive to contact by a said vehicle for assuming an on condition;

(ii) second normally off switch means located at said lower track and responsive to movement of a front roller to a position immediately downstream of said ramp for assuming an on condition;

(iii) and means connecting said first and second switch means in series with said power means for operation of said power means when said first and second switch means are both on to raise said downstream end of said ramp for a period of time sufficient to shunt said rear roller assembly to said upper track;

(i) a lid member normally closing said slot, and means connecting said lid member with said power means for said lid member to move upwardly coincident with upward movement of said ramp to expose said slot; and, (j) and means mounted at said upper track and spaced substantially downstream along said conveyor for directing a rear roller assembly on said upper track back to said lower track.

2. A conveyor system according to claim 1 wherein said second switch means include an elongated dolly treadle plate, plate mounting means mounting said treadle plate for said treadle plate to form a part of said lower track and for movement between a first normal position and a second position slightly depressed from said first position, said plate mounting means including means responsive to the weight of a first roller member on said treadle plate for permitting movement of said treadle plate under the weight of the first roller member to said second position thereof, said treadle plate having an upstream end located adjacent said ramp, said treadle plate being dimensioned relative to the lengths of said arm and said ramp for a first roller member of a dolly passing thereover to keep said treadle plate depressed until said rear roller assembly of such dolly has passed fully over and off the end of said ramp, and spring means biasing said dolly treadle plate to its first position.

3. A conveyor system according to claim 2 wherein said plate mounting means includes a parallel arm linkage located beneath said dolly treadle plate and mounting said dolly treadle plate so that said dolly treadle plate remains in a horizontal plane as it moves between said first and second positions thereof, said second switch means further including a switch responsive to movement of said parallel arm linkage for assuming said on condition of said second switch means.

4. A conveyor system according to claim 1 wherein said upper track has a lower surface, said ramp being hinged at its upstream end to said lower track and said ramp at its downstream end including stop means adapted to engage the lower surface of said upper track when said ramp is in said second position, to limit upward movement of said ramp past said second position.

5. A conveyor system according to claim 4 wherein said second switch means includes means responsive to movement of said dolly treadle plate from said second to said first position thereof to reverse said power means to positively drive said ramp back to said first position thereof.

6. A conveyor system according to claim 5 wherein said first switch means includes a floor treadle switch laterally spaced from said conveyor and responsive to the weight of a wheel of said vehicle to assume said on condition thereof.

7. A conveyor system according to claim 6 wherein said floor treadle switch is longitudinally elongated and wherein the spacing of said dollies along said chains is such that the rear wheel of a said vehicle will be on said floor treadle switch at the same time as a first roller of a said dolly will be on said dolly treadle switch, thereby to select a dolly behind the rear wheel of such vehicle.

* * * * *

UNITED STATES PATENT AND TRADEMARK OFFICE

CERTIFICATE OF CORRECTION

PATENT NO. : 4,266,482

DATED : May 12, 1981

INVENTOR(S) : Ivan J. Barber

It is certified that error appears in the above—identified patent and that said Letters Patent is hereby corrected as shown below:

On the title page, Item [56], after references cited add:

| | | | | |
|---|---|---|---|---|
| [56] | 3,554,132 | 1/1971 | Hanna et al | 104/178(x) |
| | 3,554,133 | 1/1971 | DeAngelis et al | 104/172B |
| | 3,596,606 | 8/1971 | Smith et al | 104/172B |
| | 3,693,392 | 9/1972 | Watson | 104/172B |
| | 3,724,390 | 4/1973 | Beer et al | 104/172B |
| | 3,745,932 | 7/1973 | Czerwinski | 104/172B |
| | 3,789,766 | 2/1974 | Hurwitz | 104/172B |
| | 4,044,686 | 8/1977 | VanBrakel | 104/172B |
| | 1,136,393 | 12/1968 | Great Britain | 198/732 |

[57] ABSTRACT, lines 7 and 9, "threadle" should be --treadle--;

Column 3, line 27, "rollers 80" should be --rollers 90--;

Column 3, line 34, "ohter" should be --other--;

Column 5, line 42, "have" should be --has--;

Column 5, line 49, after "guided up" delete --to--;

Column 6, line 68, "150°" should be --150'--;

Signed and Sealed this

*Fifteenth* Day of *December 1981*

[SEAL]

*Attest:*

GERALD J. MOSSINGHOFF

*Attesting Officer*

*Commissioner of Patents and Trademarks*